United States Patent [19]

Nünnerich et al.

[11] 4,434,950

[45] Mar. 6, 1984

[54] WINDING-ON DEVICE FOR PAPER SHEETS AND LENGTHS OF TEXTILE

[76] Inventors: Wilhelm Nünnerich, 33, Kölner Grenzweg, D-4780 Lippstadt; Peter Schmidt, 41, Ziethenweg, D-4790 Paderborn, both of Fed. Rep. of Germany

[21] Appl. No.: 358,173

[22] Filed: Mar. 15, 1982

[30] Foreign Application Priority Data

Mar. 30, 1981 [DE] Fed. Rep. of Germany ... 8109362[U]

[51] Int. Cl.[3] ..... B65H 17/04; B65H 17/22

[52] U.S. Cl. ..... 242/67.2; 242/67.3 R

[58] Field of Search ..... 242/67.2, 67.1 R, 67.3 R, 242/65, 55, DIG. 2; 226/122, 121, 152, 156

[56] References Cited

U.S. PATENT DOCUMENTS

| | | | |
|---|---|---|---|
| 1,123,337 | 1/1915 | Main | 242/67.2 |
| 1,815,064 | 7/1931 | Legg | 242/65 |
| 1,973,839 | 9/1934 | Zenner | 226/152 X |
| 2,571,795 | 10/1951 | Tyler et al. | 226/121 X |
| 2,622,957 | 12/1952 | Wise | 242/67.2 X |
| 3,316,769 | 5/1967 | Nordin | 226/156 X |
| 3,321,148 | 5/1967 | Mack | 242/67.2 |
| 3,371,883 | 3/1968 | Hoffman et al. | 242/67.3 R |

FOREIGN PATENT DOCUMENTS

| | | | |
|---|---|---|---|
| 52-20026 | 2/1977 | Japan | 242/67.3 R |

OTHER PUBLICATIONS

*IBM Tech. Disclosure Bulletin,* "Typewriter Ribbon Feed", O'Daniel et al. 9/63.

*IBM Tech. Disclosure Bulletin,* "Ribbon Feed Mechanism", Schaefer, 5/63.

*Primary Examiner*—Stuart S. Levy

*Assistant Examiner*—Scott J. Haugland

*Attorney, Agent, or Firm*—Krass, Young & Schivley

[57] ABSTRACT

A device for winding-on sheets of material (3), particularly sheets of paper and lengths of textile, includes a winding-on device and a feed unit (6,8) coupled with the winding-on spindle (4) of the winding-on device through a belt drive (21,22,26), which unit discontinuously feeds the material sheet (3) to the winding-on device. The belt (22) of the belt drive (21,22,26) is elastically extensible in its lengthwise direction, while the winding-on spindle (4) is joined with one part (15) of a locking catch (15,13) the other part (13) of which is intermittently movable into its released position by means of a driver arrangement (9) joined with the feed unit (6,8). The device is particularly suitable for winding-on paper sheets in print units.

7 Claims, 5 Drawing Figures

WINDING-ON DEVICE FOR PAPER SHEETS AND LENGTHS OF TEXTILE

DESCRIPTION

1. Technical Field

The invention relates to a device for winding-on sheets of material, particularly paper sheets and lengths of textile, which are fed discontinuously by means of a feed unit to the winding-on device wherein the feed unit and a winding-on spindle of the winding-on device are coupled by a belt drive.

With a device of this type it is not possible to drive the feed unit and the winding-on device discontinuously and synchronously, since with the increasing winding-on diameter the length of the material sheet segment would on per driving step also increases.

2. Background Art

Winding-on devices are known which drive the winding-on spindle with a continually acting torque. When the sheet of material runs through a processing station before the winding-on, in which station a processing of the material sheet is done while it is standing still, the torque acting on the winding-on spindle must be limited so that the sheet of material will not be pulled out of the processing station during the processing step. Thereby the attainable strength of the roll is limited, so that the latter requires much space.

Moreover, winding-on devices are known with a drive which is controlled by means of a message, for example, a contact detecting the formation of a reserve of the material to be wound on in front of the winding-on device. These winding-on devices also have the abovementioned disadvantage of a loose roll formation.

DISCLOSURE OF THE INVENTION

The invention is based on the problem of supplying a simply constructed device of the type mentioned at the outset which makes possible the formation of a firm roll without the danger existing that the sheet of material will be pulled out of the processing station during the processing step.

This problem is solved according to the invention by having the belt of the belt drive elastically extensible in its lengthwise direction and having the winding-on spindle joined with one part of a locking catch, the other part of which is intermittently movable into its released position by means of a driver arrangement joined with the drive unit.

In the winding-on device, according to the invention, the elastic belt is elastically elongated and thereby tensioned during one or more feed steps of the feed unit so that when the locking catch is released the winding-on spindle is jerkily rotated by the elastic belt released of its tension and thereby the sheet of material is wound on. By the jerky rotation of the winding-on spindle the sheet of material to be wound on is put under tension, so that a firm roll is formed. The driving energy transmitted from the feed unit by way of the belt drive to the winding-on spindle is therefore first stored in the elastic belt before it is transmitted jerkily to the winding-on spindle when the locking catch is released.

According to a preferred embodiment, the winding-on spindle is joined in rotationally fixed form with a locking wheel with locking teeth formed on its periphery, between which engages a stop lever mounted to be swivelable between an engaged position and a released position, where the stop lever is swivelable by means of a pawl which is arranged in the path of the driving teeth of a driving wheel joined in a rotationally fixed manner with the drive spindle of the feed unit.

Further features and advantages of the invention are seen from the subclaims and the following description, which in combination with the annexed drawings explain the invention on the basis of a paper winding-on device in a print unit represented as an embodiment example.

BEST MODE FOR CARRYING OUT THE INVENTION

Figure 1:
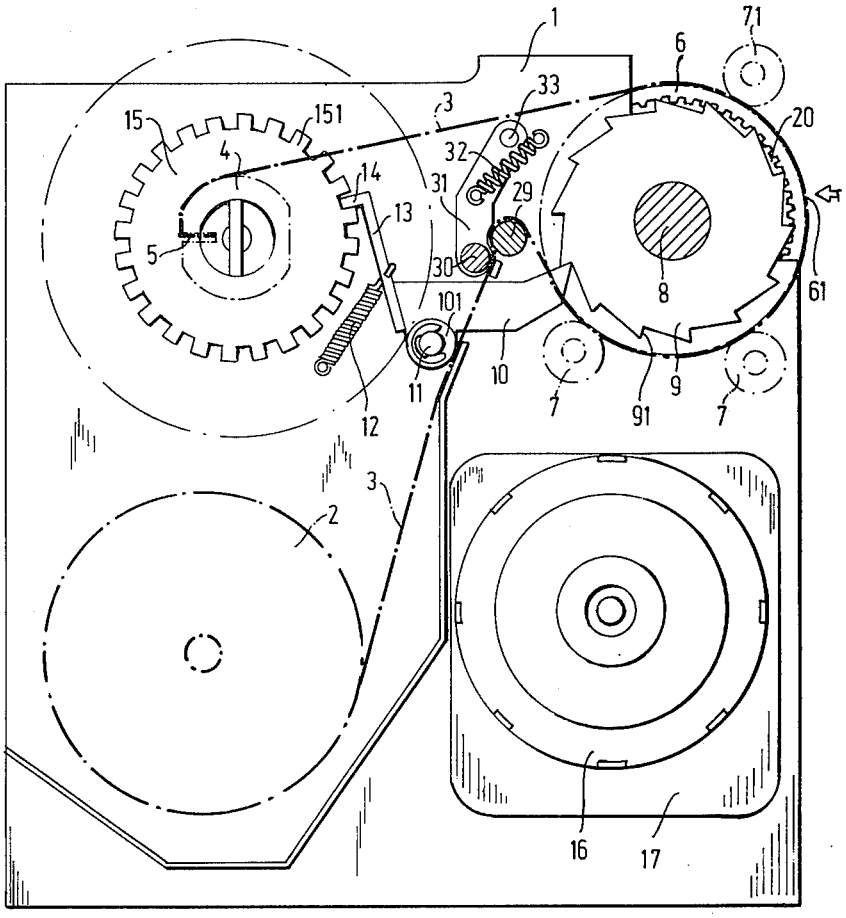
FIG. 1 shows a partially diagrammatic view of a bearing plate of the print unit as seen from the interior of the print unit in the direction of the axis of the winding-on spindle.

The paper winding-on device represented in combination with a print unit or printing mechanism. The figures respectively show one, namely the right bearing plate 1 of the print unit on which are supported all of the structural parts required for its operation.

From a paper supply roll 2 a paper sheet 3 is led around a guide bar 29 and further around a roller 6 of a print unit to a winding spindle or a winding-on spindle 4, where the front end of the paper sheet is held in a clamping slot 5. Near the guide bar 29 is arranged a tension pin 30 which at both ends is fastened onto pressing levers 31 which in turn are pivoted in a rivet 33 on the bearing plate 1 and are prestressed by means of springs 32 in such a way that the tension pin 30 is pressed against the paper sheet 3 and keeps the paper sheet taut before it runs into the processing station. By means of back-up rollers 7 and 71 the paper sheet is pressed against the roller in order to achieve a good transfer of the take-off force from the print roller 6 to the paper sheet 3.

Figure 2:
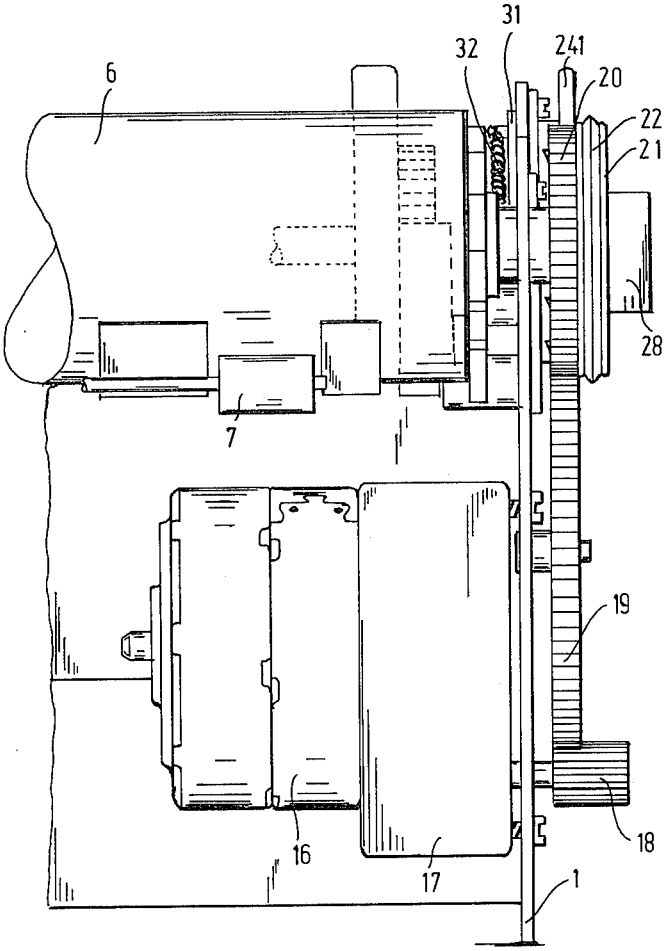
FIG. 2 shows a partial front view of the print unit.
Figure 3:
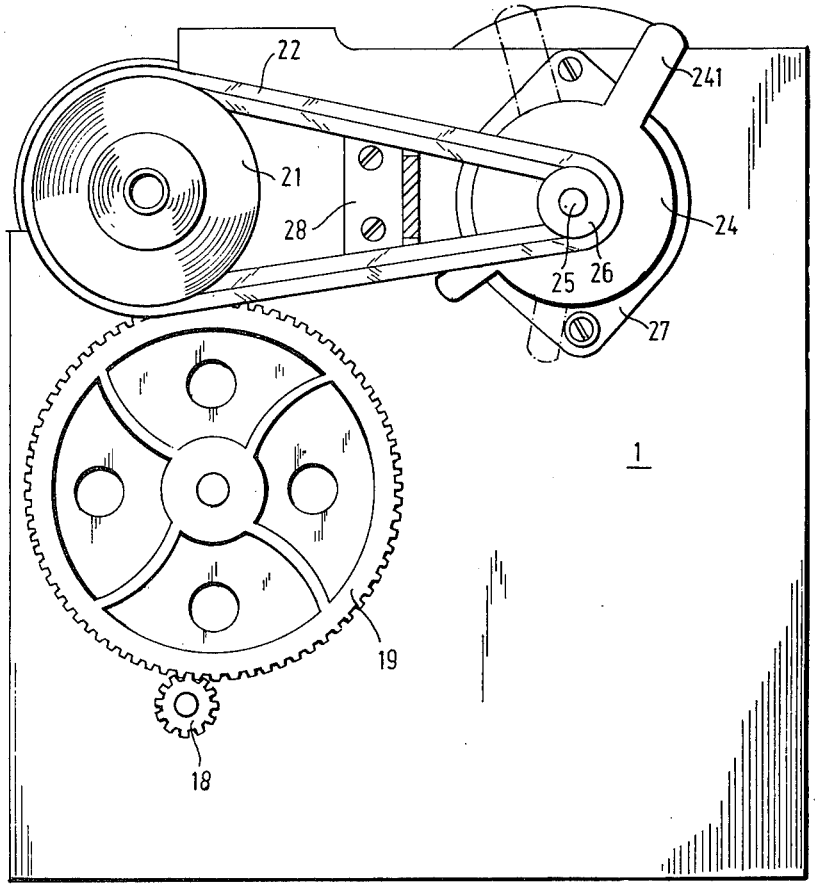
FIG. 3 shows a top plan view of the outer side of the bearing plate represented in FIG. 1 with the drive of the feed unit, and FIGS. 4 and 5 respectively show a partial top plan view of the drive of the feed unit and of the winding-on spindle in various operating positions.
Figure 4:
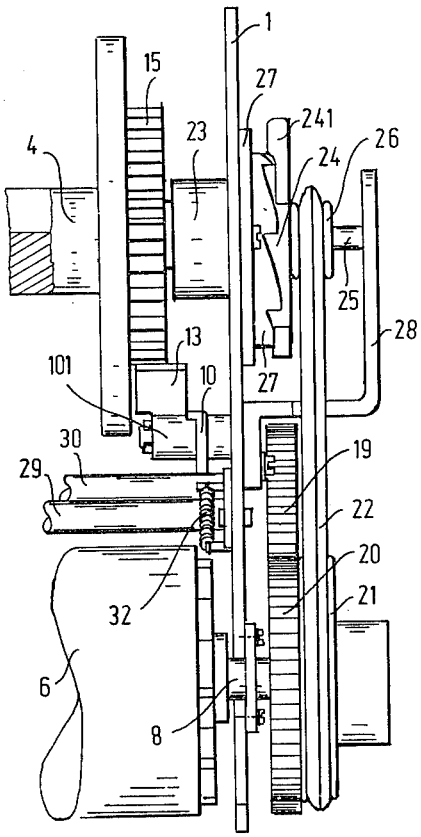
Figure 5:
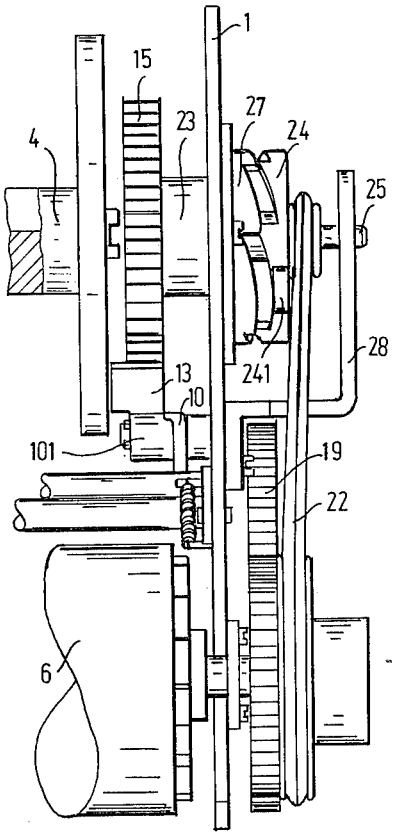

In FIG. 2 is seen the drive of the print roller 6. A motor 16 drives a gear 20 by way of a gear unit 17, a pinion gear 18 and an intermediate gear 19, which gear 20 is rotationally fixed onto the spindle 8 of the print roller 6. A V-belt pulley 21 is also joined to the spindle 8, which pulley, by way of an elastic square V-belt 22, drives a V-belt pulley 26 and a pivot 25, joined rotationally fixed to this, of the winding drive. The pivot 25 is supported in axially movable form in a holding angle 28 and in a spring housing 23, in order to be able to disengage the winding spindle 4 from the pivot 25 and take the roll out of the print unit. For the disengaging, a shifting unit is provided which includes a toothed stator 27 fastened on the bearing plate 1 and, pivoted on the pivot 25, a toothed ejector 24 with an operating lever 241. FIG. 4 shows the ejector 24 engaged with the stator 27 corresponding to the coupling position between pivot 25 and winding spindle 4. In this position, the pivot 25 is held in a torque-transmitting connection with the winding spindle 4 by means of a spring accommodated in the spring housing 23. FIG. 5, on the other hand, shows the ejector 24 in its ejected position in which the teeth of the ejector 24 and stator 27 overlap one another due to a rotation of the ejector. Thereby the pivot 25 is shifted to the right (as seen in FIGS. 4 and 5) in an axial direction against the initial stress of the spring accommodated in the spring housing 23 and the torque transmitting connection between the pivot 25 and the winding spindle 4 is released, so that the roll can be removed from the print unit.

The pivot 25 is moreover rotationally fixed to a locking wheel 15 with locking teeth 151 in which a stop lever 13 engages with a pawl 14. The stop lever 13 is pivoted by means of a bushing 101 on a pin 11 (FIG. 1) which in turn is fastened onto the bearing plate on the one hand and on the stop lever 13 on the other puts the stop lever 13 under initial tension in its locking position. The stop lever 13 on its end turned away from the pawl 14 shows a ratchet lever 10 which is intended to engage in a driving wheel 9 which is fastened onto the pivot 8 of the print roller 6. The driving wheel 9 on its periphery shows driving teeth 91 the mutual spacing of which corresponds to about two lines of print each.

As soon as a line advance occurs on the print roller 6, the paper sheet 3 forms a small reserve loop behind the latter, while the V-belt 22 stretches, since the pawl 14 prevents any rotation of the pivot 25 and therefore of the winding spindle 4. After one or two more line advances, the driving tooth 91 directly engaging with the ratchet lever 10 has then swiveled the ratchet lever 10 and therewith the stop lever 13 far enough that the pawl 14 is lifted out of the locking teeth 151 and the V-belt 22 jerkily drives the winding spindle 4 and thus the roll by way of the pivot 24. Thereafter the stop lever 13 locks again. The jerky winding motion leads to the formation of a firm roll. On the other hand, it does not cause the paper to be pulled out of the print position on the print roller, since the paper sheet, due to the guiding around the guide bar 29, winds around a large winding region of the print roller 6. There is no steady pull on the paper sheet from the winding-on device, since the locking catch absorbs the belt tension.

The elastic square V-belt ensures an adequate torque, as well as an adequate storage of the feed energy and compensates for the continually changing transmission ratio with an increasing roll thickness by sliding on the pulley 26.

The elasticity of the V-belt 22 must be chosen such that the energy stored in the V-belt 22 from the direction of the drive during the locking of the winding spindle 4 is sufficient to overcome the frictional losses which occur in the bearings of the winding spindle 4 and the bearings of the pivot 25 with a full roll. Any excess energy remaining after the rotation of the winding spindle has taken place is captured by the renewed locking of the locking catch 13, 14 and 15 and acts in reverse on the paper sheet 3 only very briefly, until the locking, so that the paper sheet 3 cannot be subsequently pulled out of the processing position 61.

The energy elastically storable in the belt results on the one hand, from the frictional engagement between the V-belt 22 and the belt pulley 26; and on the other hand from the stretching of the V-belt 22 and the tensioned side between the belt pulleys 26 and 21 during this frictional engagement.

A substantial advantage of the device according to the invention is that the stress of the drive through the winding-on device does not depend on the variable size of the roll, but rather solely on the torque required to stretch the V-belt 22 by way of the pulley 21.

We claim:

1. Apparatus for winding-up of a continuous sheet material such as paper on a take-up roll comprising:

a supply of sheet material;

a take-up roll upon which the sheet material is to be discontinuously wound in relatively large increments;

a drive means comprising a rotatable drive element which rotates incrementally and discontinuously in relatively small increments;

an axially elastically stretchable belt connecting the drive element to the take-up roll to transfer rotational motion from the drive element to the take-up roll when the take-up roll rotates freely but to store energy in the form of elastic tension when the take-up roll is locked against rotation; and locking means interconnecting the drive element and the take-up roll to normally lock the take-up roll against rotation but to release the take-up roll after the drive element has rotated a predetermined number of said small increments.

2. Apparatus as defined in claim 1 wherein the take-up roll is mechanically interconnected to rotate with a locking wheel having locking teeth formed on the periphery thereof, said locking means comprising a stop lever pivotally mounted to rotate between a first position in which a portion thereof engages the locking teeth of the locking wheel and a second position in which the lever is disengaged from the locking teeth of the locking wheel, the locking lever being mechanically connected to the drive means to be rotated between the respective positions thereof according to the rotation of the drive element in the drive means.

3. Apparatus as defined in claim 1 wherein the belt is made of rubber.

4. Apparatus as defined in claim 1 wherein the locking means comprises a locking wheel, means for mounting the locking wheel for rotation with the take-up roll, said mounting means being operative to permit axial movement of the locking wheel relative to the take-up roll for disengagement therefrom, and ratchet means for mechanically connecting the belt of the drive means to the locking wheel.

5. Apparatus as defined in claim 1 wherein the drive means comprises an intermediate roll at which a work function such as printing is performed on the sheet material, the sheet material being threaded in a path from the supply means to the intermediate roll and thence to the take-up roll.

6. Apparatus as defined in claim 5 wherein the drive means further includes motor means mechanically connected to the intermediate roll.

7. Apparatus as defined in claim 6 further including a bias means urging the locking lever into the first position.

* * * * *